United States Patent [19]

Bodine

[11] Patent Number: 4,615,400

[45] **Date of Patent: * Oct. 7, 1986**

[54] SONIC DRILLING SYSTEM EMPLOYING SPHERICAL DRILL BIT

[76] Inventor: Albert G. Bodine, 7877 Woodley Ave., Van Nuys, Calif. 91406

[ * ] Notice: The portion of the term of this patent subsequent to Jul. 9, 2002 has been disclaimed.

[21] Appl. No.: 725,648

[22] Filed: Apr. 22, 1985

Related U.S. Application Data

[63] Continuation-in-part of Ser. No. 505,954, Jun. 20, 1983, Pat. No. 4,527,637, which is a continuation-in-part of Ser. No. 262,650, May 11, 1981, Pat. No. 4,403,665.

[51] Int. Cl.[4] ..... E21B 7/24

[52] U.S. Cl. ..... 175/55; 175/107

[58] Field of Search ..... 175/55, 56, 107, 343, 175/371, 394

[56] References Cited

U.S. PATENT DOCUMENTS

| | | | |
|---|---|---|---|
| 2,336,337 | 12/1943 | Zublin | 175/354 |
| 3,138,213 | 6/1964 | Brandon | 175/56 |
| 4,157,122 | 6/1979 | Morris | 175/371 |
| 4,168,755 | 9/1979 | Willis | 175/343 |

*Primary Examiner*—Stephen J. Novosad
*Assistant Examiner*—William P. Neuder
*Attorney, Agent, or Firm*—Edward A. Sokolski

[57] ABSTRACT

Sonic energy in a cycloidal or quadrature vibration action pattern is generated in a main vibratory drill assembly by means of a sonic oscillator employing an eccentrically weighted rotor. The sonic energy is transmitted down the drill assembly to the drill bit to cause precession of the bit around the bottom of the drill bore in a cycloidal fashion. The drill assembly is coupled to the drill bit through a spherical ball and socket bearing which enables universal rotation of the bit so that it is not constrained along any particular axis. Thus, the bit is free to tip and to rotate on the sonic drill assembly in an orbiting cycloidal fashion in response to the energy transmitted thereto.

20 Claims, 10 Drawing Figures

SONIC DRILLING SYSTEM EMPLOYING SPHERICAL DRILL BIT

This application is a continuation in part of my application Ser. No. 505,954, filed June 20, 1983, now U.S. Pat. No. 4,527,637 which in turn, is a continuation in part of my application Ser. No. 262,650, filed May 11, 1981, now U.S. Pat. No. 4,403,665.

This application relates to a well drilling system employing cycloidal sonic energy for its drilling action, and more particularly, to such a system which employs a rotatably mounted spherical bit.

In my application Ser. No. 505,954, filed June 20, 1983, a drilling system is described which employs a drill bit which is caused to precess around the bottom of the drill bore in a cycloidal fashion. This causes highly effective cutting action on the bottom and particularly the adjacent side walls of the bottom portion of the bore by virtue of the cycloidal precessing action. All of these cycloidal sonic drills desirably tend to drill the bore hole somewhat larger than the bit diameter which is a great aid when entering the hole with a new unworn bit. In the system of my prior application the bearing for the bit is typically a cylindrical bearing having its axis parallel to the axis of the sonically driven bar, or is otherwise axially constrained. Such bearing constraint for the bit has several disadvantages. First, the cutter teeth located to the center of the bit (i.e. near the longitudinal axis thereof), tend to slide around sidewise in the center region of the bottom face of the bore hole. In highly abrasive formations such lateral sliding can be quite destructive to the cutter teeth. Also, with substantial longitudianl downward force of the bit the roller teeth near the longitudinal axis of the bit tend to "grab" or dig into the formation, tending to momentarily become a fulcrum which instantaneously establishes a turning axis at this point. This causes teeth near to the "grabbing" teeth also to roll and to indent into the formation, thus with teeth at a substantially different radius from such grabbing teeth tending to slide to a degree depending upon the extent of such radius. Moreover, teeth at the bottom point being near the axis have difficulty rolling. This tends to provide a non-uniform cutting action and wearing of the teeth which is particularly undesirable when dealing with very hard formations.

The device of the present invention overcomes the aforementioned shortcomings by virture of the use of a spherical cutter element which is supported on a spherical ball and socket bearing which does not constrain the bit rotation axially. Thus the bit of the present invention can choose its own cycloidal rotation axis and is not constrained to an axis determined by its support bearings as in the case of the bit of the prior art device. Therefore in response to the longitudinal downward acting force, and the lateral precessing vibratory force, the cycloidal axis of rotation of the bit will tend to assume a slanted orientation, this axis veering in response to the longitudinal and lateral drive forces. Further, incipient sliding motion of a tooth will, in response to the resistance offered by the formation to such sliding motion, result in an accomodation by the bearing effecting a change in the bit axis accordingly. Thus, all the teeth tend to roll around on the bearing rather than major loaded areas sliding thereon as is the case with the bearings of the prior art.

It is therefore an object of this invention to provide an improved bearing action for the cutter bit of a cycloidal sonic drilling system.

It is a further object of this invention to minimize the wear on the cutter teeth and improve the cutting action of a drill bit employed in a cycloidal sonic drilling system.

Other objects of this invention will become apparent as the description proceeds in connection with the accompanying drawings of which, FIG. 1 is an elevational view, partially in cross section of a first embodiment of the invention;

Figure 1:
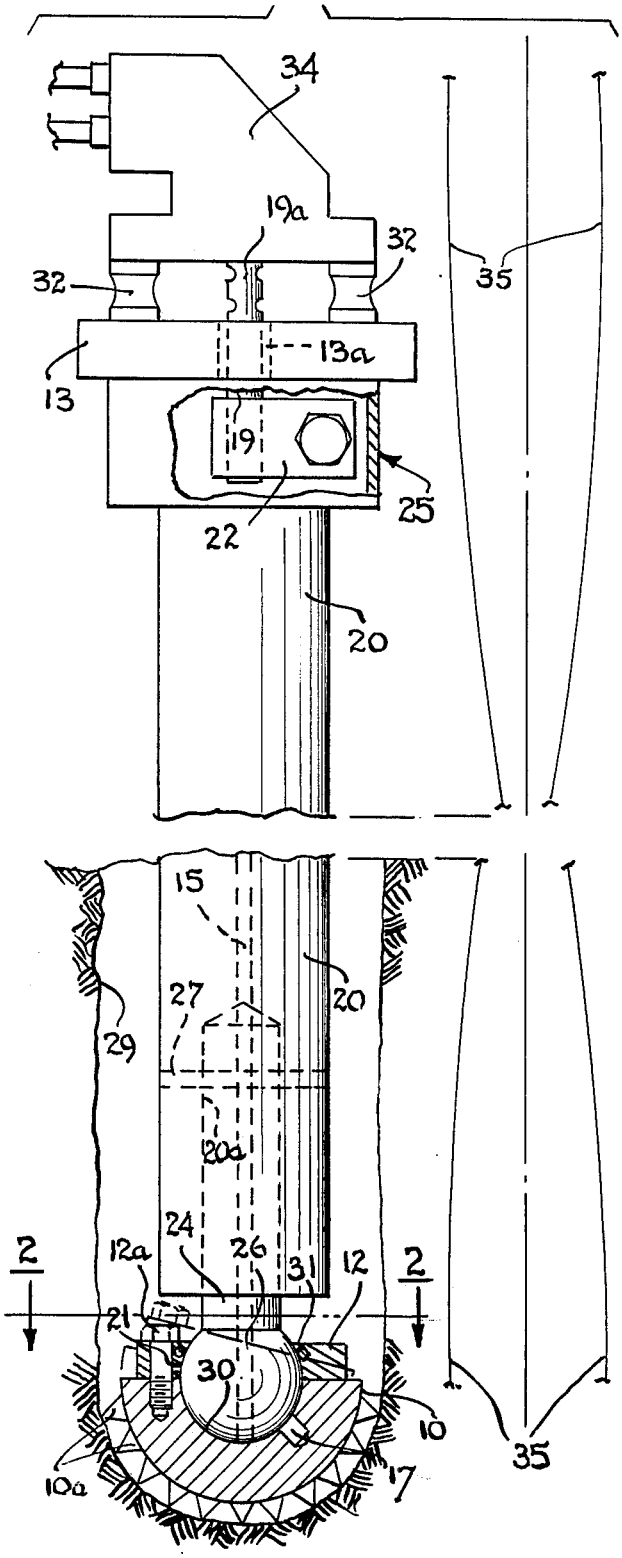
Figure 2:
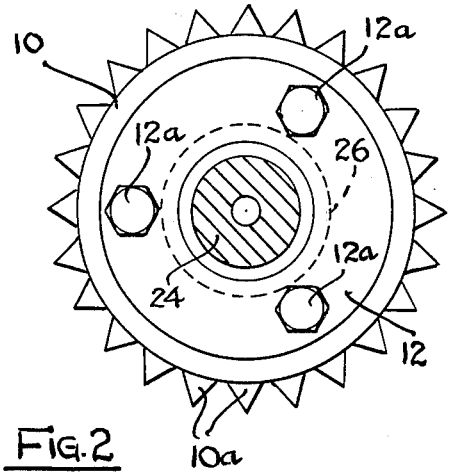
FIG. 2 is a cross sectional view taken along the plane indicated by 2—2 in FIG. 1.
Figure 3:
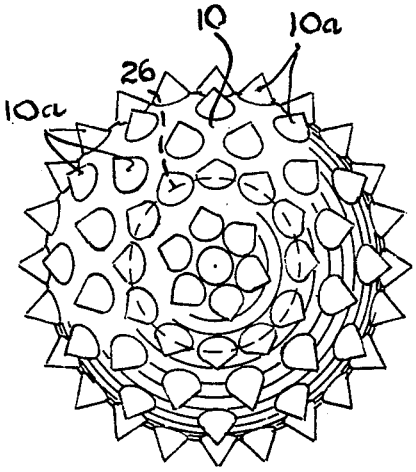
FIG. 3 is a bottom plan view of the first embodiment.

Referring now to FIGS. 1-3, a first embodiment of the invention is illustrated. The sonic cycloidal energy generating means employed in the present invention is similar to that employed in my aforementioned patent application Ser. No. 505,954, and therefore will be but briefly described herein. This system employs an orbiting mass oscillator 25 which is mounted firmly in energy transmission relationship to the main vibratory drill assembly which may comprise drill stem 20. This orbiting mass oscillator has a sleeve bearing 13*a* formed in platform 13, which carries shaft 19 which has an eccentrically weighted rotor 22, driven by flexible drive shaft 19*a*. Motor 34 is mounted on platform 13 on vibration isolators 32, shaft 19*a* being the drive shaft from this motor. Attached to the housing of orbiting mass oscillator 25 is drill stem 20 which is fabricated of a flexible material such as steel. Drill bit 10 is in the shape of a hemisphere and has a plurality of cutter teeth 10*a* positioned over the entire outer surface thereof. A spherical ball-socket bearing 30 is formed between the inner spherical surface of cutter bit 10, and ball member 26, the cutter bit having limited universal freedom of motion on bearing 30. The cutter bit is retained to ball member 26 by means of ring-shaped retainer member 12, which has an inner spherical surface, this retainer member being held to bit 10 by means of bolts 12*a*. The bit member 10 is free to turn and to move angularly as, for example, indicated by the dashed outline. Ball member 26 is integrally formed with elongated shank 24, this shank being pressed firmly into bored out portion 20*a* of drill stem 20 and retained to the drill stem by means of pin member 27.

When rotor 22 is rotatably driven, it generates a cycloidal vibratory sonic force in drill stem 20. Rotor 22 is preferably driven at a frequency such as to set up a resonant standing wave vibration in a cycloidal vibration mode in the drill stem as indicated by graph lines 35. For an explanation of cycloidal or quadrature vibration, reference is made to my U.S. Pat. Nos. 4,271,915 and 4,266,619. This cycloidal energy is transferred to the drill bit in the following manner. The rotary elastic lateral whirling of the lower end of the drill stem 20 causes the ball member 26 to orbit in a closed path which is generally circular. This causes the bit 10 to precess around in the bottom region of bore hole 29, with those teeth on the outer periphery of the bit in rolling engagement with the bore hole. As downward pressure is applied to the bit, the teeth toward the center thereof tend to "dig in", rather than only those at the outer periphery, as in the prior art drilling bit. The axis of bit rotation need not be parallel to the axis of stem 20. The aforementioned "dig in" fulcrum teeth are thus more toward the center of the bit and thus the center teeth do less sliding. The axis of rotation assumes an orientation generally normal to the instantaneous fulcrum. Lubricant is supplied to the bearing 30 through passage 15 from a conventional pressurized lubricant reservoir (not shown). Pockets 17 and 21 are provided along the bearing to trap debris which might enter the bearing area, such debris being driven into these traps by virtue of the centrifugal force developed with the cycloidal rotation of the bit. An "O" ring 31 is used to seal the bearing so as to prevent the escape of lubricant therefrom.

Figure 4:
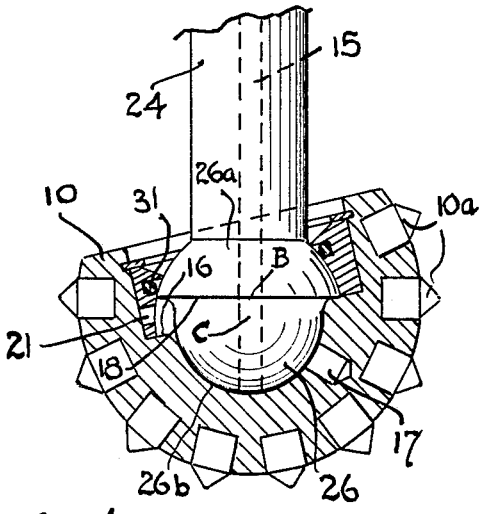
FIG. 4 is a cross sectional view illustrating a second embodiment of the invention.

Referring now to FIG. 4, a second embodiment of the invention is shown. This second embodiment is similar to the first except for the fact that means are provided on ball portion 26 to limit the tipping motion or orientation of the bit on the spherical bearing 30. This end result is achieved by forming a spherical section **26*a* on the upper portion of the ball member which has a greater radius than the portion 26*b* forming the lower portion of the spherical bearing 26. Thus, a shoulder 16 is formed on the inner surface of the bit socket which in conjunction with shoulder 18** on the ball member forms a limiting stop to tipping motion of the bit. It should be noted that the center "C" of the ball member is displaced from the center B of the bit in a direction towards the lower end of the bit. This displaces the center of the thrust provided by the ball member ahead of the center of drag of the bit, which tends to stabilize the operation of the bit.

Referring now to FIGS. 5, 5A, 5B and 6, a further embodiment of the invention is illustrated. This embodiment is particularly adapted for use in deep well drilling wherein it is desirable to generate the sonic energy close to the bit rather than transmitting the energy down from the surface along an elongated drilling stem. Thus, in this embodiment, the spherical bit and the cycloidal oscillator as well as the drive therefore, are combined into a single sub assembly, wherein the quadrature vibrational energy is transmitted directly from the oscillator to the bit. In this embodiment, the main vibratory drill assembly which may comprise drill casing 20 provides compliance which operates in conjunction with the mass of the bit and its power drive assembly to form the resonant system with the compliant reactance of the drill casing matching the mass reactance of the drill and drive assembly to effect the desired resonant operation. The oscillator 25 is down hole immediately adjacent to ball member 26 which forms the ball and socket bearing for drill bit 10. The drill bit structure and its ball and socket bearing are similar to those in the prior embodiments and operate in the same fashion to effect precession of the bit around the bottom of the drill bore in a cycloidal fashion. The oscillator, the drive therefor, and the assembly of the oscillator and its drive down hole in a common assembly with the bit member are substantially different from the prior embodiments.

Oscillator 25 has an unbalanced rotor 22, this end result being achieved by forming a cavity **22*a*** on one side of such rotor. Thus, when the rotor is rotatably driven it generates the desired cycloidal vibration.

Oscillator rotor 22 is rotatably driven by means of a turbine drive 40, the turbine being driven by the flow of mud through the drill stem as indicated by arrows "A'-'-"C". The turbine drive operates in the same general fashion as that described in my U.S. Pat. No. 3,633,688 with the flow of mud from the surface which is normally used to flush out the drill cuttings being employed to drive the turbine blades.

Figure 6:
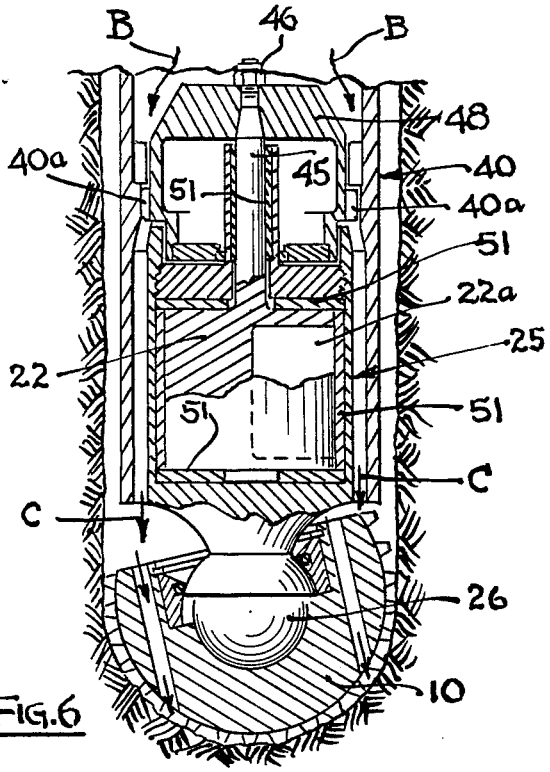
FIG. 6 is an elevational view in cross-section illustrating the oscillator employed in the embodiment of FIG. 5.

The structure and operation of the turbine drive and the oscillator is shown more particularly in FIG. 6. The mud flow indicated by arrows "B" is directed against the turbine blades **40*a* to rotatably drive turbine 40. After it passes through the turbine blades, the mud flows as indicated by arrows "C" past the oscillator housing. Turbine drive assembly 48 is attached to the drive shaft 45 of the rotor 22 of oscillator 25 by means of nut 46. The oscillator rotor 22 which as already noted is unbalanced by virture of cavity 22*a* formed therein is rotatably supported in the housing for oscillator 25 on bearing 51 which may be of Micarta. Thus, the turbine rotatably drives rotor 22 to develop cycloidal vibrational energy in the housing of oscillator 25**.

A counter balancing resonator 42 in the form of a steel bar may be suspended from drill collar 47 in applications where a high degree of isolation is desired. A weight 43 forming a pendulum structure is suspended from the end of rod 42. Mounted in holes formed in pendulum 43 are a plurality of gas filled bladders 45. These bladders may be in the form of hose members made of a flexible material such as fabric-rubber with metal ferrules and pressure plugs on their ends. The bladders are pressurized so that they swell and are thus held in place in their receiving holes in pendulum member 43. A plurality of ports 49 are formed in the wall of pendulum 43 to provide fluid communication with the exterior of the bladders. These gas filled bladders provide an acoustic shunt which prevents the generation of vibrational pressure in the mud. The counter balancing resonator provided by shaft 42 and pendulum 43 avoids the transmission of sonic energy to the drill collar 47 thus avoiding the dissipation of energy in such collar. The rod member 42 and pendulum 43 form a quarter wave vibrating system at the resonant frequency of the vibrational energy generated by oscillator 25 to effectively counterbalance the resonant vibration system formed by the drill bit assembly and drill stem 20. The quarter wave resonant vibration of the balancing system is indicated by wave forms 52 while the quarter wave vibration of the resonant system formed by the drill stem and the bit assembly is indicated by wave forms 53. As can be seen, both vibration systems have nodal points in the vicinity of the drill collar 47 indicating the lack of vibrational energy in this region.

Figure 5A:
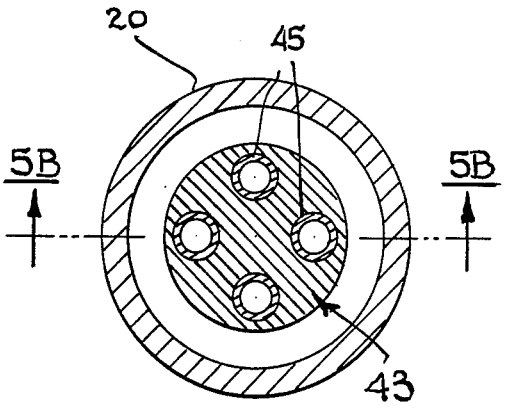
FIG. 5A is a cross-sectional view taken along the plane indicated by 5A—5A in FIG. 5.
Figure 5B:
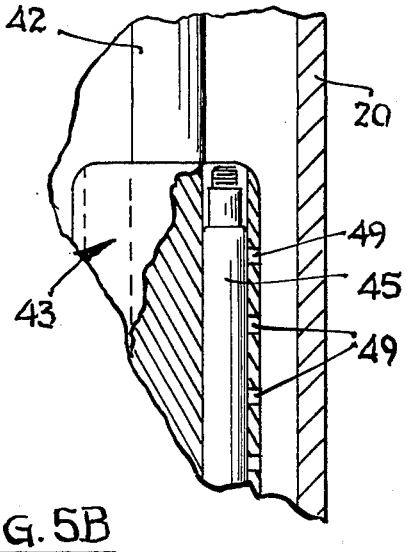
FIG. 5B is an enlarged sectional view of the pendulum of the embodiment of FIG. 5.
Figure 5:
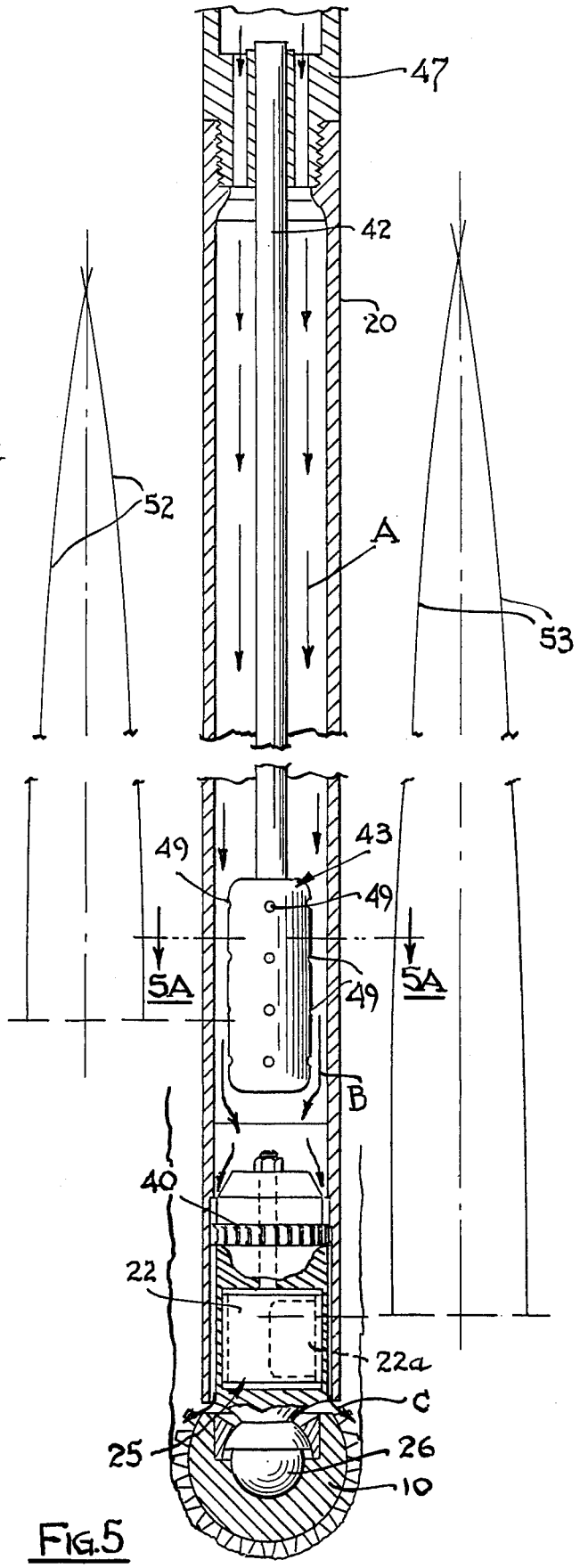
FIG. 5 is an elevational view in cross-section of a further embodiment of the invention.

The device of FIG. 5 can also be operated very effectively for drilling in a non-resonant manner by making the stem 20 of a length which does not engender resonance. Stem 20 thus need be sufficiently elastic only to provide lateral bending compliance to permit the desired quadrature vibration of the oscillator and bit, without thus causing undesirable vibration of drill collar 47. The top end of stem 20, at collar 47, tends to stand still because of the mass inertia of the drill collar while the lower end of stem 20 bends about so as to provide quadrature freedom for the oscillator and bit.

Figure 7:
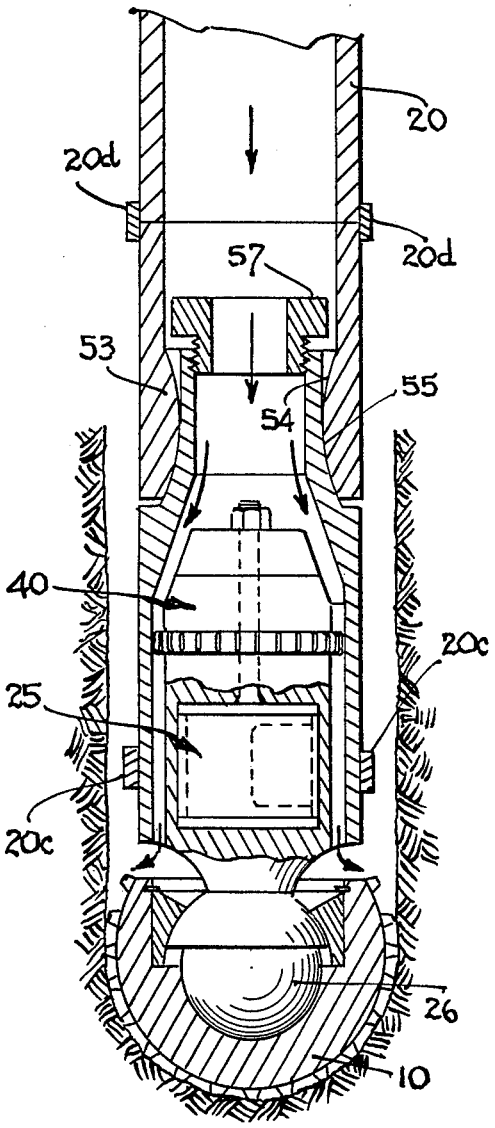
FIG. 7 is an elevational view in cross section of a modified version of the embodiment of FIG. 5.

Referring now to FIG. 7, a modified version of the turbine-oscillator-bit assembly of the previous embodiment is illustrated. This embodiment may be operated in a non-resonant mode. The modification is involved with a ball-swivel connection which is provided between the turbine-oscillator-bit assembly and the drill stem which thus does not have to bend elastically. Thus, a ball-swivel support 53 is provided by means of protrusions 54 formed on the drill stem and mating surfaces 55 formed on the turbine housing. A shoulder member 57 is provided to limit the relative lateral travel between the suspended assembly and the drill stem, and also to function as a retainer to retain the two assemblies to each other. This embodiment enables the bit and oscillator to have complete mechanical freedom of tilting in the conical orbiting path so that the bit is able to roll and rotate around on the work material.

The device of FIG. 7 is particularly useful for drilling deviated holes, such as angularly slanted side holes to provide augmented liquid drainage into the main well. All elements are the same as described for the embodiment of FIG. 5 except that spherical swivel joint 53 permits lateral angularity limited by the diameter of shoulder 57. Bumpers **20*c* and 20*d*** also limit the deviation angle.

Figure 8:
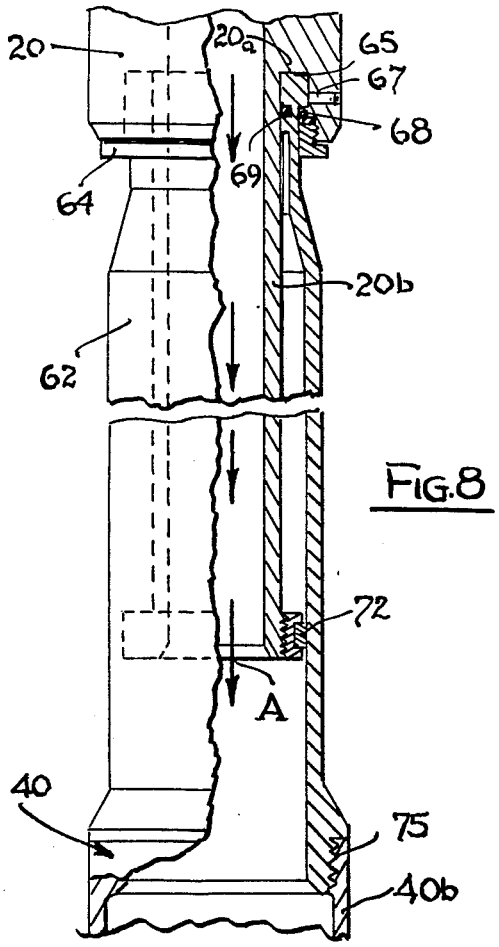
FIG. 8 is an elevational view in cross section illustrating an alternative coupling between the drill stem and oscillator drive assembly.

Referring now to FIG. 8, an alternative coupling for coupling the drill stem and oscillator-drive assembly for non-resonant operation is illustrated. This embodiment is similar to that of FIG. 7 except for the type of coupling between the drill stem and the oscillator and related assembly. In this embodiment, a flange coupling is employed to permit nutational mechanical vibration of the bit, oscillator and turbine assembly, not requiring resonance. Otherwise, the structure is the same as that in the previous embodiments, particular that of FIG. 7. In this embodiment the drill stem 20 has a flange **20*a* formed on the end thereof into which the end of a relatively stiff hollow coupler member 62 is fitted and retained by means of circular threaded retainer member 64. A contact shoulder 65 is formed between flange 20*a* and the end of coupler 62, the shoulder area being lubricated with grease through grease filler plug 67. O-rings 68 and 69 are provided to maintain the grease along the contact surfaces. Coupler member 62 need not be resonant, the upper flange end nutating. A spindle 20*b* is provided at the end of the drill stem to center and guide the coupler 62, a shock absorbing rubber ring 72 being provided between coupler 62 and the spindle to assure controlled clearance therebetween and to minimize wear on the relatively moving parts. Coupler 62 is coupled to the housing 40*b* of the turbine 40 by suitable threaded coupling 75. The bit, thus, is mechanically free to nutate or precess along with its associated assembly. This precessing action is particularly effective in hard rock wells where large down forces are required and wherein the flange and shoulder design of this embodiment provide very effective load carrying capacity. The long guidance spindle 20*b*** limits angularlity and thus assures the drilling of a straight hole.

While the invention has been described and illustrated in detail, it is to be clearly understood that this is intended by way of illustration example only, and it is not to be taken by way of limitation, the spirit and scope of the invention being limited only by the terms of the following claims:

I claim:

1. In a sonic well drilling system for drilling a bore hole, said system including means for generating sonic energy in a lateral quadrature vibration pattern and a main vibratory drill assembly driven by said sonic energy in a sonic cycloidal mode of vibration, the improvement being a drill bit assembly coupled to said main vibratory drill assembly to receive sonic energy from the main vibratory drill assembly comprising, a shank portion joined on one end thereof to the lower end of the main vibratory drill assembly, a ball portion joined to the other end of the shank portion, and a bit element having a spherical socket formed therein, said spherical socket mating with said ball portion to form a ball-socket bearing, and means for retaining the bit element in said bearing for limited universal freedom of rotation, the ball portion orbiting in a closed path in response to the sonic energy and effecting precession of the bit around the bore hole.

2. The system of claim 1 wherein said bit element has a spherical shape with cutter teeth distributed over the spherical surface thereof.

3. The system of claim 1 and further including a sealing ring for sealing the bearing to prevent the escape of lubricating fluid therefrom.

4. The system of claim 3 and further including passage means for use in feeding lubricant to said bearing.

5. The system of claim 3 and further including pocket means located in said bit element along the bearing for trapping debris.

6. The system of claim 1 and further including annular shoulder means for limiting the tipping motion of the bit relative to the drill stem.

7. The system of claim 1 wherein the means for retaining the bit element in the bearing comprises a circular retainer member having an inner spherical surface which surface matingly engages the ball portion, and means for retaining said retainer member to the bit element.

8. The system of claim 1 wherein the means for generating the sonic energy comprises an orbiting mass oscillator having an eccentrically weighted oscillator, the oscillator being directly coupled to said ball portion, and means for rotatably driving said rotor.

9. The system of claim 8 wherein the means for driving said rotor comprises a turbine and means for directing a fluid stream through said turbine to effect the rotation thereof.

10. The system of claim 9 wherein the vibratory drill assembly and the bit element are driven in a resonant cycloidal mode of vibration.

11. The system of claim 10 and further including counterbalancing resonator means coupled to the stem for counterbalancing the resonant vibration of the vibratory drill assembly and bit.

12. The system of claim 1 wherein said counterbalancing resonator means comprises a bar member suspended within said vibratory drill assembly and a pendulous weight suspended from the lower end of said bar member.

13. The system of claim 12 wherein said pendulous weight includes gas filled bladder means incorporated therein forming an acoustic shunt.

14. A sonic system for drilling a bore hole comprising:

a drill stem extending into said bore, an orbiting mass oscillator having an eccentrically weighted rotor coupled to the lower end of said drill stem near the bottom of said bore, means for rotatably driving the rotor of said oscillator to generate sonic energy in a lateral quadrature mode of vibration, a ball member joined to said oscillator to receive said sonic energy, a bit element having a spherical socket formed therein, said spherical socket mating with said ball member to form a ball-socket bearing, and means for retaining the bit element in said bearing for limited universal freedom of motion, the ball portion orbiting in a closed path in response to the sonic energy and effecting precession of the bit around the bore hole.

15. The system of claim 14 wherein the means for rotatably driving the oscillator rotor comprises a turbine coupled to said rotor and means for directing a stream of fluid through said turbine.

16. The system of claim 15 wherein the drill stem, ball member and bit element are driven in a resonant cycloidal mode of vibration.

17. The system of claim 16 and further including counterbalancing resonator means coupled to the stem to counterbalance the resonant vibration of the stem, ball member and bit element so as to minimize wasteful dissipation of energy.

18. The system of claim 17 wherein said counterbalancing resonator means comprises a bar member suspended within the drill stem and a pendulous weight suspended from the lower end of said bar member.

19. The system of claim 14 and further including ball-swivel means for coupling the drill stem to the oscillator for permitting limited universal freedom of motion between the oscillator and stem.

20. The system of claim 14 and further including flange coupling means for coupling the drill stem to the oscillator to permit nutating motion between the oscillator and stem in response to the vibrational energy.

* * * * *